US007061348B2

(12) United States Patent
Schalk et al.

(10) Patent No.: US 7,061,348 B2
(45) Date of Patent: Jun. 13, 2006

(54) CIRCUIT BREAKER WITH A MOVEABLE PLUG CONTACT

(75) Inventors: Adelbert Schalk, Wutöschingen (DE); Fritz Ehrenspberger, Marthalen (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 11/229,570

(22) Filed: Sep. 20, 2005

(65) Prior Publication Data

US 2006/0061439 A1 Mar. 23, 2006

(30) Foreign Application Priority Data

Sep. 20, 2004 (EP) ..... 04405597

(51) Int. Cl.
*H01H 75/00* (2006.01)

(52) U.S. Cl. ..... 335/6; 335/197; 335/202

(58) Field of Classification Search ..... 335/6, 335/196, 197, 200, 202; 439/59, 110, 114, 439/246–252
See application file for complete search history.

(56) References Cited

FOREIGN PATENT DOCUMENTS

| | | |
|---|---|---|
| DE | 103 06 548 | 9/2004 |
| JP | 2003-242875 | 8/2003 |

OTHER PUBLICATIONS

Innovation mit System—Schutzgeräte mit Stecktechnik (Systematic innovation—plug-in protective device), Apr. 16, 1999, ABB Schweiz AG, Normelec/CMC Components, P.O. Box CH-9048, Zurich/Switzerland.

*Primary Examiner*—Ramon M. Barrera
(74) *Attorney, Agent, or Firm*—Buchanan Ingersoll PC

(57) ABSTRACT

The circuit breaker is intended for installation in a low-voltage distribution board having a socket and having at least two busbars which are guided parallel, are held on the socket and are each associated with one pole conductor of a multiphase power supply system. This circuit breaker has an enclosure as well as a plug contact for making contact with one of the busbars. The plug contact can be positioned as a function of the position of the busbar with which contact is to be made, and is held on a contact mount, which can be moved transversely with respect to the busbars and can be locked to the circuit breaker enclosure. In a circuit breaker such as this, a pole conductor change from one busbar to another busbar can be carried out quickly and without the use of any tools.

13 Claims, 3 Drawing Sheets

CIRCUIT BREAKER WITH A MOVEABLE PLUG CONTACT

This application claims priority to European Application No. 04405597.8, filed Sep. 20, 2004, the contents of which are incorporated herein by reference in their entirety.

TECHNICAL FIELD

The present invention relates to the field of circuit breakers as claimed in the precharacterizing clause of patent claim 1. Circuit breakers such as these are used in low-voltage distribution boards on the basis of a socket and at least two busbars which are guided parallel, are held on the socket and are each associated with one pole conductor of a multiphase alternating-current power supply system. In low-voltage distribution boards such as these, the current which is supplied from a low-voltage power supply system is distributed with the aid of built-in service switches to components such as cables, motors, apparatuses or installations. Since the switches are in the form of circuit breakers, the current-carrying components and installations are protected quickly and reliably against the consequences of overload and short-circuit currents. The circuit breakers which are used each have an enclosure, as well as a plug contact which is held on the enclosure. The circuit breaker can be installed easily and quickly by pivoting the circuit breaker on one edge of the socket. During the pivoting process, the plug tulip is plugged onto one of the busbars. In order to keep the number of circuit breaker types small, the plug contact can be positioned as a function of the position of the busbars. Depending on the position of the busbar which is to be connected to the switch, the plug contact can then be positioned suitably, before installation. Only a single circuit breaker type is then required for all the pole conductors.

PRIOR ART

A circuit breaker of the type mentioned initially is described in the smiss-line S technical catalogue entitled "Innovation mit System—Schutzgeräte mit Stecktechnik" [Systematic innovation—plug-in protective device] from ABB Schweiz AG, Normelec/CMC Components, P.O. Box CH-9048, Zurich/Switzerland. When a pole conductor change occurs, that is to say in the event of a change from one busbar to another busbar, a lock is released in this circuit breaker which unlocks the plug contact, which is in the form of a tulip, from a depression in the circuit breaker enclosure, positions it in a different enclosure depression, and then locks it again. During this process, the enclosure parts such as the plug contact, which are composed of plastic, may be severely loaded owing to the robust structure.

DESCRIPTION OF THE INVENTION

The invention as it is specified in the patent claims is based on the object of providing a circuit breaker of the type mentioned initially in which pole conductor changes can be carried out quickly and with little effort, in particular without the use of any tools.

In a circuit breaker according to the invention, the plug contact is held on a contact mount which can be moved transversely with respect to the busbars and can be locked to the circuit breaker enclosure. These measures mean that, when a pole conductor change takes place, the plug contact now no longer need be removed from the circuit breaker enclosure, or be reinserted into the circuit breaker enclosure at a different position again, but that the plug contact can remain in the circuit breaker enclosure and is just moved to the position associated with another busbar and another pole conductor. The method steps involved in this process, specifically the unlocking, movement and locking, can in practice be carried out by hand by suitable design and arrangement of the contact mount and of a locking mechanism coupled to it. Since the plug contact is fitted to the contact mount only once, neither the plug contact nor the contact mount is mechanically unacceptably highly loaded during a pole conductor change. At the same time, a flexible connecting conductor of the plug contact is now also guided completely in the interior of the circuit breaker enclosure. This avoids wiring faults, while less visible wiring at the same time improves the clarity of the low-voltage distribution board which is equipped with the circuit breaker according to the invention.

The contact mount advantageously has an opening, which is bounded by a surround, for the plug contact to pass through. The plug contact can thus be mounted conveniently in the contact mount and is protected by the surround and a contact cover (which may be fitted to the surround and is guided in the direction of the free end of the plug contact) against access and thus against damage.

A connecting element for holding a projection or a depression in the plug contact can be formed in the surround. The plug contact is held on the contact mount such that it cannot rotate by insertion of a connecting element into a congruent connecting element on the contact mount.

The functions of movement and locking can be provided with little effort and with good reliability by a blocking element for a lock and a sliding body being held on the contact mount, and by a section (which is aligned in the pushing direction) of a guide track which holds the sliding body, and latching elements which are spaced apart from one another in the pushing direction being formed in the enclosure in order to hold the blocking element in an interlocking manner.

If the blocking element contains a flexion spring which is clamped in at one end and is fitted with a latching tab at its free end then, when a pole conductor change takes place, the functions of unlocking of the old pole conductor and locking of the new pole conductor are achieved quickly and conveniently by bending and reducing the load on the flexion spring. If an operating element which is passed out of the circuit breaker enclosure is additionally fitted to the flexion spring, then the lock is released during a pole conductor change by finger pressure on the operating element, and the contact mount is moved from the old to the new pole conductor. The lock is closed again by releasing the lever, and the circuit breaker which is intended for the new pole conductor can now be inserted into the distribution board again. Overextension of the flexion spring is in this case avoided by fitting a limiting element to the flexion spring, which strikes the circuit breaker enclosure beyond a bending stress which is still permissible.

If a tongue is held on the contact mount, which can be moved along that section of the guide track which is aligned in the pushing direction and along an adjacent curved section of the guide track, and which tongue has an electrically insulating tongue section, then this tongue closes the circuit breaker enclosure irrespective of the pole conductor which can be selected on the circuit breaker. The flexible conductor which is electrically conductively connected to the plug contact is thus completely surrounded by a dielectric enclosure and now no longer requires any electrical insulation.

In one advantageous development of the circuit breaker according to the invention, an indication of the selected pole conductor is also made possible after installation in the distribution board by the tip of the tongue being guided to an opening in the circuit breaker enclosure, which opening can still be seen after the circuit breaker has been installed in the low-voltage distribution board.

A large number of parts are saved and particularly simple and economic manufacture are made possible by manufacturing the contact mount, the blocking element and the tongue integrally as a dielectric body. It is particularly advantageous for the sliding body, the operating element, the limiting element and/or the stiffened area to be formed in the dielectric body.

BRIEF DESCRIPTION OF THE FIGURES

One exemplary embodiment of the invention will be explained in more detail in the following text with reference to the drawings, in which.

APPROACHES TO IMPLEMENTATION OF THE INVENTION

Figure 1:
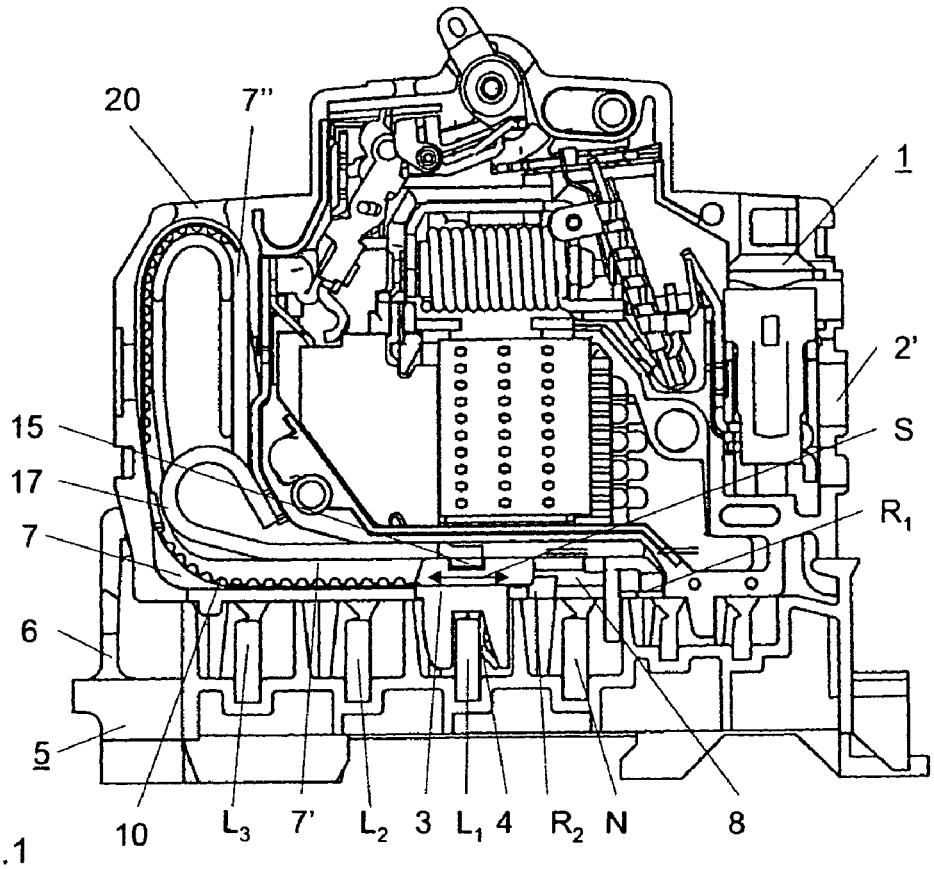
FIG. 1 shows a side view of one embodiment, which is installed in a low-voltage distribution board, of a circuit breaker according to the invention having a two-part enclosure, whose enclosure half facing the viewer has been removed.

In all of the figures, the same reference symbols denote parts having the same effect. In FIG. 1, the reference symbol 1 denotes a circuit breaker having a two-part enclosure composed of a polymer insulating material, of which only the enclosure half 2' that is located on and under the plane of the paper can be seen. The circuit breaker 1 also has a plug contact 4, which is held in a contact mount 3 which is likewise manufactured from a polymer insulating material. The circuit breaker is installed in a low-voltage distribution board 5 which has a socket 6 onto which four busbars $L_1$, $L_2$, $L_3$ and N are plugged. The three busbars $L_1$, $L_2$ and $L_3$ are each connected to one of three pole conductors of a three-phase power supply system while, in contrast, the busbar N is connected to the neutral conductor of the power supply system. The busbars are routed parallel on one plane, and are aligned at right angles to the plane of the paper.

Figure 2:
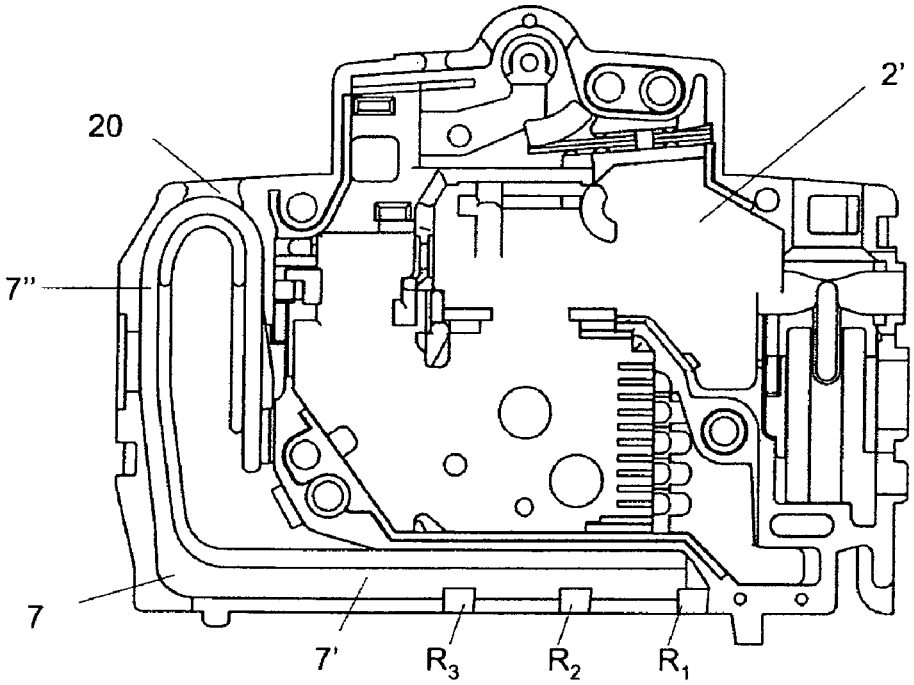
FIG. 2 shows a side view of the enclosure half which is still present in the circuit breaker shown in FIG. 1.

The contact mount 3 is guided in a track 7 which is in the form of a groove and is formed symmetrically in both halves of the enclosure. Only one part of the guide track 7, which is formed in the enclosure half 2', can be seen in FIG. 2. The contact mount 3 is held in the enclosure (FIG. 1) such that it can be moved in the direction of a double-headed arrow S along a straight section 7' of the guide track 7. FIG. 2 also shows, particularly clearly, three depressions which are incorporated in the edge of the enclosure half 2', are used as latching elements $R_1$, $R_2$, $R_3$ and lock the contact mount 3 in three different positions on the enclosure 2. If contact is made between the plug contact 4 and the busbar $L_1$ as shown in the illustration in FIG. 1, then a blocking element 8 which can be seen in FIG. 1 latches into the element $R_1$. After removal of the circuit breaker 1 from the low-voltage distribution board 5 and opening of the lock, the contact mount 3 and the plug contact 4 can be moved in the direction of the double-headed arrow S transversely with respect to the busbars $L_1$, $L_2$ and $L_3$ until the blocking element 8 has latched in the respective element $R_2$ or $R_3$. The circuit breaker 1 then makes contact with the respective busbar $L_2$ or $L_3$ on insertion into the low-voltage distribution board 5.

Figure 3:
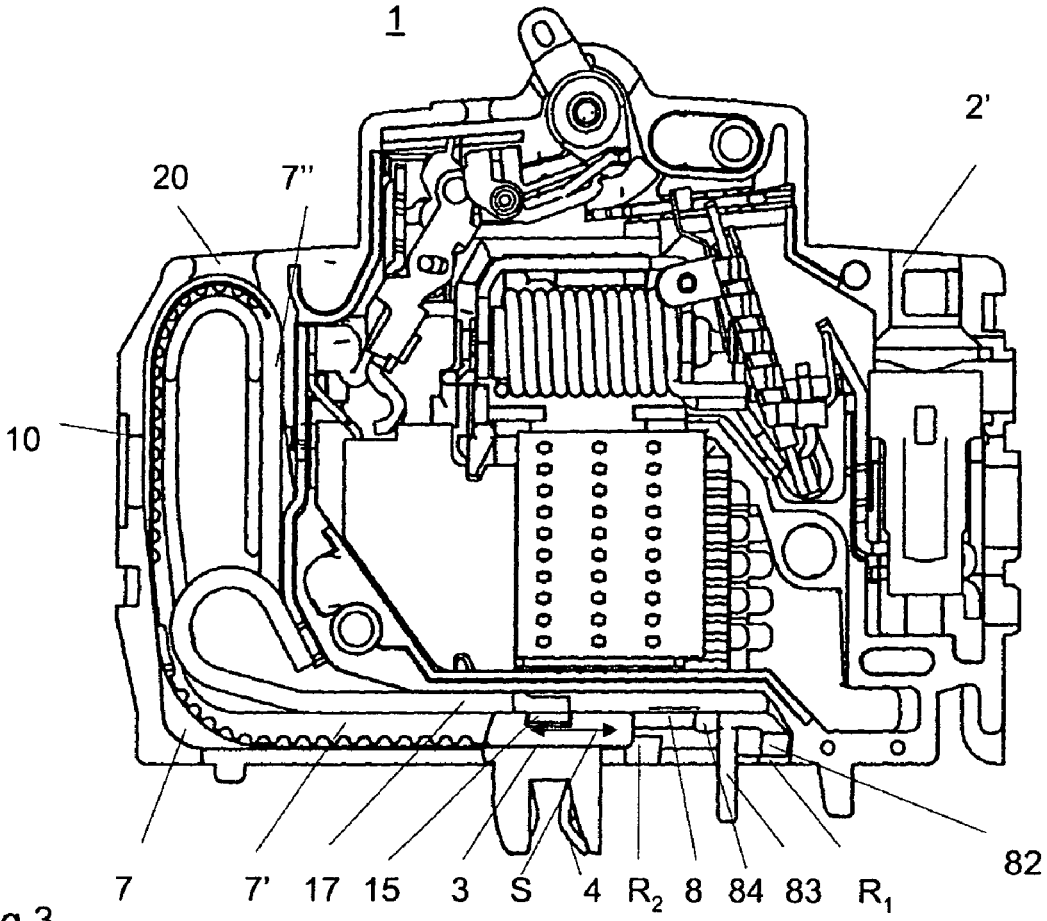
FIG. 3 shows a side view of the circuit breaker shown in FIG. 1 after its removal from the low-voltage distribution board.
Figure 4:
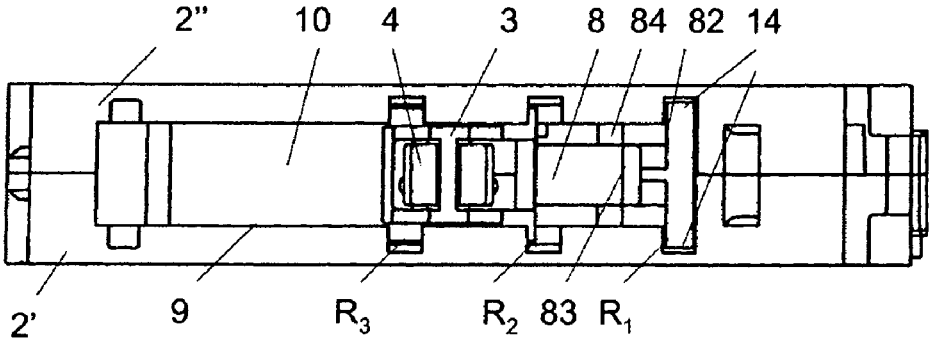
FIG. 4 shows a view of the circuit breaker shown in FIG. 3 from underneath.
Figure 5:
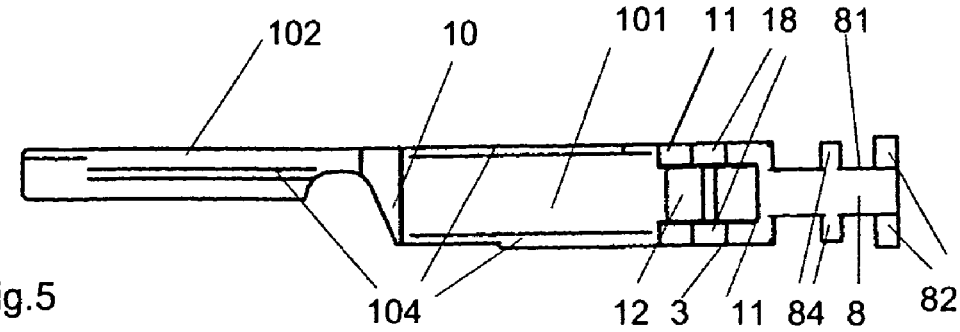
FIG. 5 shows a plan view of a mount for holding a plug contact before installation in the circuit breaker as shown in FIGS. 1 to 4.

FIGS. 3 and 4 illustrate the circuit breaker 1 removed from the low-voltage distribution board. This illustration shows that the enclosure has two symmetrical enclosure halves 2', 2", and a rectangular opening 9 is arranged in the base of the enclosure, through which the contact mount 3 and the plug contact 4 are passed, and which is covered to the right and left, respectively, of the contact mount 3 by the blocking element 8 and a tongue 10. The latching elements $R_1$, $R_2$, $R_3$ are formed in the edges that are formed by the two enclosure halves 2', 2". As can be seen from FIG. 4, each of the latching elements is formed by two grooves 14 which are opposite one another and spaced apart and are each formed in in each case one of the two enclosure halves 2', 2".

As can be seen from FIGS. 5 to 8, the contact mount 3, the blocking element 8 and the tongue 10 are formed integrally. A polymer plastic based on a polyamide has been found to be suitable as the material for this part.

The contact mount 3 has an opening 12, which is bounded by a rectangular surround 11 (FIGS. 5 and 6), for the plug contact to pass through. A two-part contact cover 13, which is guided in the direction of the free end of the plug contact, is fitted to the two sides of the surround 11 which are guided in the movement direction (FIGS. 6 to 8) and this contact cover 13 protects the plug contact against being touched in an undesirable manner. Furthermore, a connecting element which is formed by two grooves 18 is formed in the upper face of the surround 11 and is used to hold two projections 15 on the plug contact 4, one of which can be seen in FIGS. 1 and 3. If required, the connecting element may also contain two projections rather than two grooves 18, which interact with two depressions, which are each in the form of a groove, in the plug contact 4. Once the plug contact 4 has been inserted into the opening 12 in the contact mount 3, the projections 15 are fixed in the two grooves 18, and the plug contact 4 is thus protected against rotation.

Two sliding bodies 16 and the blocking element 8 are integrally formed outside the surround 11. The two sliding bodies are each guided in the section 7' of the track 7 which is aligned in the direction of the double-headed arrow S. The blocking element 8 interacts with in each case one of the latching elements $R_1$, $R_2$, $R_3$, which are spaced apart from one another in the pushing direction S, forming a locking apparatus. The blocking element 8 contains a flexion spring 81 which is clamped in at one end, is in the form of a leaf spring and on whose free end two tabs 82 are integrally formed, which can be snapped in an interlocking manner into one of the latching elements (into the latching element $R_1$ in the illustration shown in FIGS. 1 and 3).

Furthermore, an operating element 83 (FIGS. 6 and 8) is fitted to the flexion spring 81, is passed out of the circuit breaker enclosure 2', 2", is guided upward by finger pressure against the force of the flexion spring 81 out of the low-voltage distribution board 5 when a pole conductor change takes place after removal of the circuit breaker 1, and in the process counteracts the locking of the contact mount 3. The contact mount 3 and the plug contact 4 can now be moved—as described above—and can be locked at a different point, using the restoring force of the flexion spring 81. Overextension of the flexion spring 81 by excessive finger pressure is avoided by fitting a limiting element 84 to the flexion spring 81 (FIGS. 5 and 8), which limiting element 84 strikes the circuit breaker enclosure 2', 2" at the top above a bending load which is still permissible.

Figure 6:
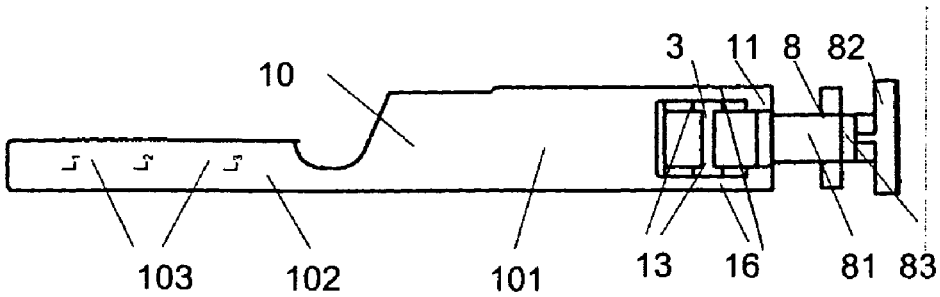
FIG. 6 shows a view of the contact mount from underneath.
Figure 7:
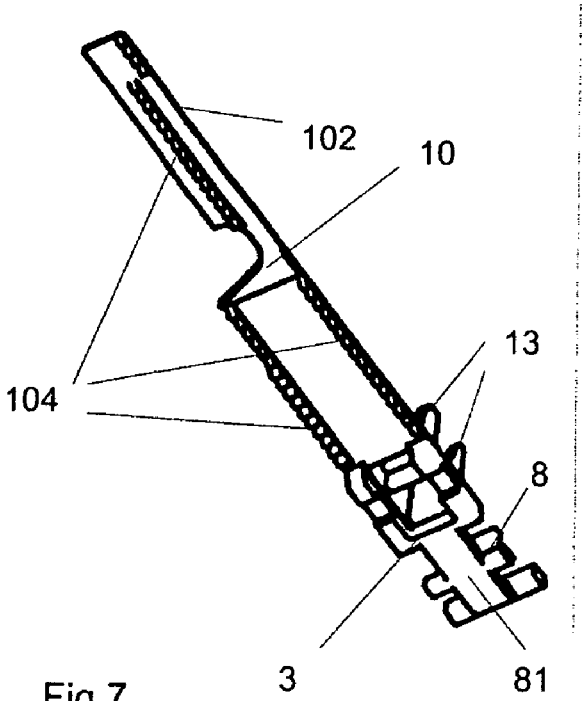
FIG. 7 shows a perspective view of the contact mount shown in FIGS. 5 and 6.
Figure 8:
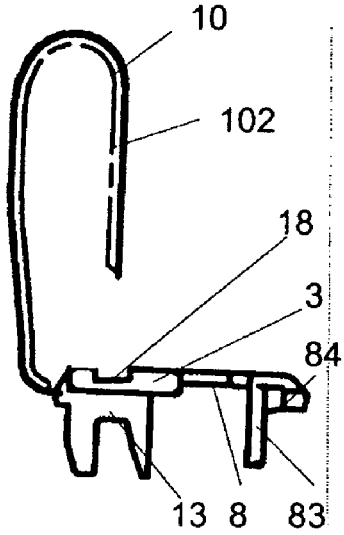
FIG. 8 shows a side view of the contact mount shown in FIGS. 5 to 7 after installation in the circuit breaker as shown in FIGS. 1 to 4.

The tongue 10 is also integrally formed on the surround 11 and can be moved along the section 7', which is aligned in the pushing direction S, and an adjacent, curved section 7" of the guide track 7 (FIGS. 1 to 3), and has an electrically insulating tongue section 101. This tongue section closes the opening 9 on the outside and thus insulates a flexible electrical conductor 17, which is electrically conductively connected to the plug contact 4 and is generally in the form of a braid (FIGS. 1 and 3). This electrical conductor therefore does not require the conductor insulation that was previously necessary. The tip of the tongue, which is annotated with the reference symbol 102, is guided to an opening 20 (FIGS. 1 to 3) in the circuit breaker enclosure, which opening 20 can still be seen after installation of the circuit breaker 1 in the low-voltage distribution board 5. An inscription 103, which can be seen in FIG. 6, is provided on the tongue tip 102, and indicates at the opening 20 that pole conductor $L_1$, $L_2$ or $L_3$ which is effective via the busbar with which contact has been made in this case in the circuit breaker 1 on installation of the circuit breaker 1 in the low-voltage distribution board 5. Stiffened areas 104 are used to make it easier to move the tongue 10 and to increase its mechanical strength. These stiffened areas are in the form of a Venetian blind and can thus be slightly curved along the guide track in the track section 7". As can be seen, the individual elements of each blind are formed by studs which are formed in the tongue 10 in such a way that adjacent studs are held such that they can pivot against one another, in the form of a spring joint.

LIST OF REFERENCE SYMBOLS

| | |
|---|---|
| 1 | Circuit breaker |
| 2', 2" | Enclosure halves, enclosure |
| 3 | Contact mount |
| 4 | Plug contact |
| 5 | Low-voltage distribution board |
| 6 | Socket |
| 7 | Guide track |
| 7', 7" | Track sections |
| 8 | Blocking element |
| 9 | Opening |
| 10 | Tongue |
| 11 | Surround |
| 12 | Opening |
| 13 | Contact cover |
| 14 | Groove |
| 15 | Projections |
| 16 | Sliding body |
| 17 | Flexible electrical conductor |
| 18 | Connecting element, grooves |
| 20 | Opening |
| 81 | Flexion spring |
| 82 | Tabs |
| 83 | Operating element |
| 84 | Limiting element |
| 101 | Tongue section |
| 102 | Tongue tip |
| 103 | Inscription |
| 104 | Stiffened areas |
| $L_1$, $L_2$, $L_3$ | Busbars, pole conductors |
| $R_1$, $R_2$, $R_3$ | Latching elements |
| S | Double-headed arrow, movement direction |

The invention claimed is:

1. A circuit breaker for installation in a low-voltage distribution board having a socket and having at least two busbars which are guided parallel and are held on the socket, which circuit breaker has an enclosure as well as a plug contact for making contact with one of the busbars in which case the plug contact can be positioned as a function of the position of the busbar with which contact is to be made, wherein the plug contact is held on a contact mount, which can be moved transversely with respect to the busbars and can be locked to the circuit breaker enclosure.

2. The circuit breaker as claimed in claim 1, wherein the contact mount has an opening, which is bounded by a surround, for the plug contact to pass through.

3. The circuit breaker as claimed in claim 2, wherein a contact cover, which is guided in the direction of the free end of the plug contact, is fitted to the surround.

4. The circuit breaker as claimed in claim 2, wherein a connecting element for holding a projection or a depression in the plug contact is formed in the surround.

5. The circuit breaker as claimed in claim 2, wherein a blocking element for a lock and a sliding body are held on the surround, and in that a section which is aligned in the pushing direction of a guide track which holds the sliding body, and latching elements which are spaced apart from one another in the pushing direction are formed in the enclosure in order to hold the blocking element in an interlocking manner.

6. The circuit breaker as claimed in claim 5, wherein the blocking element contains a flexion spring, which is clamped in at one end and is fitted with a latching tab at its free end.

7. The circuit breaker as claimed in claim 6, wherein an operating element, which is passed out of the circuit breaker enclosure, is fitted to the flexion spring.

8. The circuit breaker as claimed in claim 7, wherein a limiting element is fitted to the flexion spring and strikes the circuit breaker enclosure beyond a bending stress which is still permissible.

9. The circuit breaker as claimed in claim 5, wherein a tongue is held on the surround, can be moved along the section, which is aligned in the movement direction, and along an adjacent curved section of the guide track, and has an electrically insulating tongue section.

10. The circuit breaker as claimed in claim 9, wherein the tip of the tongue is guided to an opening in the circuit breaker enclosure, which opening can still be seen after the circuit breaker has been installed in the low-voltage distribution board.

11. The circuit breaker as claimed in claim 9, wherein a stiffened area is formed in the tongue and is aligned in the direction of the guide track.

12. The circuit breaker as claimed in claim 8, wherein the contact mount, the blocking element and a tongue held on the surround are manufactured integrally as a dielectric body.

13. The circuit breaker as claimed in claim 12, wherein the sliding body, the operating element, the limiting element and a stiffened area formed in the tongue are formed in the dielectric body.

* * * * *